US008886082B2

(12) United States Patent
Inoue

(10) Patent No.: US 8,886,082 B2
(45) Date of Patent: Nov. 11, 2014

(54) IMAGE FORMING APPARATUS HAVING SCANNING UNIT STABLY SUPPORTED TO MAIN CASING

(71) Applicant: Kazuyuki Inoue, Hekinan (JP)

(72) Inventor: Kazuyuki Inoue, Hekinan (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 88 days.

(21) Appl. No.: 13/669,105

(22) Filed: Nov. 5, 2012

(65) Prior Publication Data

US 2013/0129379 A1 May 23, 2013

(30) Foreign Application Priority Data

Nov. 22, 2011 (JP) ..... 2011-254921

(51) Int. Cl.
*G03G 15/00* (2006.01)
*G03G 21/16* (2006.01)

(52) U.S. Cl.
CPC ..... *G03G 21/1619* (2013.01); *G03G 21/1647* (2013.01)
USPC ..... 399/110; 399/119; 399/121; 399/167; 399/358

(58) Field of Classification Search
USPC ..... 399/110, 119, 121, 167, 358
See application file for complete search history.

(56) References Cited

U.S. PATENT DOCUMENTS

| | | | | |
|---|---|---|---|---|
| 2003/0052713 | A1 | 3/2003 | Langhammer et al. | |
| 2006/0182462 | A1 * | 8/2006 | Imada et al. | 399/107 |
| 2007/0006249 | A1 | 1/2007 | Watanabe | |
| 2007/0008203 | A1 | 1/2007 | Hirama | |

FOREIGN PATENT DOCUMENTS

| | | |
|---|---|---|
| JP | 11-127293 | 5/1999 |
| JP | 2003-209467 A | 7/2003 |
| JP | 2007-013249 A | 1/2007 |
| JP | 2009-157083 A | 7/2009 |

* cited by examiner

*Primary Examiner* — Walter L Lindsay, Jr.
*Assistant Examiner* — Roy Y Yi
(74) *Attorney, Agent, or Firm* — Banner & Witcoff, Ltd.

(57) ABSTRACT

An image forming apparatus includes: a body frame accommodating an image forming unit; and a support frame supporting an image reading unit and disposed to confront the body frame in a confronting direction, the support frame having a first end portion and a second end portion opposite to each other in a first direction perpendicular to the confronting direction. The support frame includes: first and second engaging portions provided at the first and second end portions respectively; and a pair of grip portions. The body frame has a first edge portion and a second edge portion opposite to each other in the first direction, the body frame including: a first engaged portion provided at the first edge portion and engageable with the first engaging portion; and a second engaged portion provided at the second edge portion and engageable with the second engaging portion.

20 Claims, 10 Drawing Sheets

IMAGE FORMING APPARATUS HAVING SCANNING UNIT STABLY SUPPORTED TO MAIN CASING

CROSS REFERENCE TO RELATED APPLICATION

This application claims priority from Japanese Patent Application No. 2011-254921 filed Nov. 22, 2011. The entire content of the priority application is incorporated herein by reference.

TECHNICAL FIELD

The present invention relates to an electrophotographic image forming apparatus.

BACKGROUND

There is known in the art an image forming apparatus that includes an image-forming unit for forming images on paper, and an image-reading unit assembled above the image-forming unit for reading images from originals. One such image forming apparatus that has been proposed includes a device body accommodating the image-forming unit, and a scanning unit accommodating the image-reading unit and disposed above the device body.

In the conventional image forming apparatus described above, the scanning unit is mounted on the device body by first inserting a plurality of hooks provided in a center region of the device body through a plurality of corresponding fitting holes formed in the scanning unit and by subsequently sliding the scanning unit relative to the device body to secure the hooks in the fitting holes. Thereafter, the device body and scanning unit are fastened together with side plates or screws.

SUMMARY

However, when a user lifts this conventional image forming apparatus by holding the scanning unit, the hooks may shift relative to the fitting holes, causing the connection between the scanning unit and the device body to loosen and become unsteady. When the device body shifts relative to the scanning unit, load applied on the hooks increases by an amount proportionate to the degree of shift.

In view of the foregoing, it is an object of the present invention to provide an image forming apparatus having a body frame accommodating an image-forming unit, and a support frame accommodating an image-reading unit, the image forming apparatus being configured to prevent an unsteady fit between the support frame and body frame, even when a user grips the apparatus by the support frame.

In order to attain the above and other objects, there is provided an image forming apparatus including: an image forming unit configured to form images; an image reading unit configured to read images of an original; a body frame accommodating the image forming unit therein; and a support frame supporting the image reading unit and disposed to confront the body frame in a confronting direction. The support frame has a first end portion and a second end portion opposite to each other in a first direction perpendicular to the confronting direction, the support frame including: a first engaging portion provided at the first end portion; a second engaging portion provided at the second end portion; and a pair of grip portions each provided at each of the first end portion and the second end portion. The body frame has a first edge portion and a second edge portion opposite to each other in the first direction, the first edge portion and the second edge portion confronting the first end portion and the second end portion respectively when the support frame is assembled to the body frame, the body frame including: a first engaged portion provided at the first edge portion and configured to be engaged with the first engaging portion; and a second engaged portion provided at the second edge portion and configured to be engaged with the second engaging portion.

According to another aspect of the present invention, there is provided an image forming apparatus including: an image forming unit configured to form images; an image reading unit configured to read images of an original; a body frame accommodating the image forming unit therein; and a support frame supporting the image reading unit and disposed to confront the body frame in a confronting direction. The support frame has a first end portion and a second end portion opposite to each other in a first direction perpendicular to the confronting direction, the support frame including: a first engaging portion provided at the first end portion; a first protruding portion provided at the first end portion and positioned outward than the first engaging portion in the first direction; a second engaging portion provided at the second end portion; and a second protruding portion provided at the second end portion and positioned outward than the second engaging portion in the first direction. The body frame has a first edge portion and a second edge portion opposite to each other in the first direction, the first edge portion and the second edge portion confronting the first end portion and the second end portion respectively when the support frame is assembled to the body frame. The body frame includes: a first engaged portion provided at the first edge portion and configured to be engaged with the first engaging portion; and a second engaged portion provided at the second edge portion and configured to be engaged with the second engaging portion. The first protruding portion and the second protruding portion protrude outward than the first edge portion and the second edge portion in the first direction respectively when the support frame is assembled to the body frame.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Overall Structure of a Printer

Hereinafter, a printer 1 as an example of an image-forming apparatus according to a first embodiment of the present invention will be described with reference to FIGS. 1 through 9.

Figure 1:
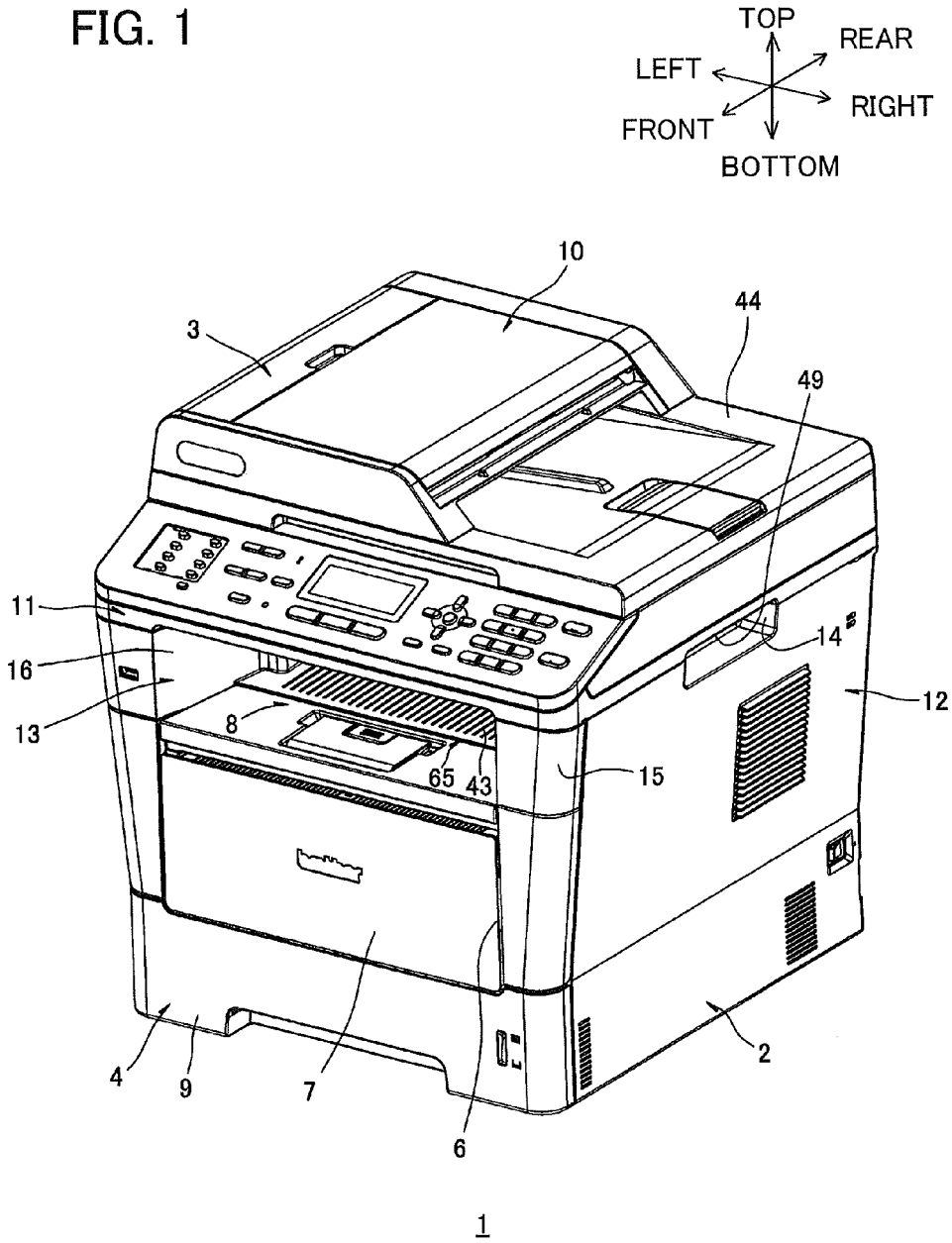
FIG. 1 is a perspective view of a printer according to a first embodiment of the present invention as viewed from upward and rightward thereof.

As shown in FIG. 1, the printer 1 is a multifunction device and includes a main casing 2, and a scanning unit 3 provided above the main casing 2 for reading image data of an original.

The main casing 2 has a general box shape. An access opening 6 is formed in one side wall of the main casing 2. A front cover 7 is pivotably provided on the same side wall of the main casing 2 in which the access opening 6 is formed. The front cover 7 is capable of pivoting about its lower end between a closed position for covering the access opening 6, and an open position for exposing the access opening 6.

In the following description, when referencing directions relative to the printer 1, the side of the printer 1 on which the front cover 7 is provided will be called the "front side," while the opposite side will be called the "rear side." More specifically, forward, rearward, upward, downward, leftward, and rightward directions relative to the printer 1 will conform to directional arrows indicated in each drawing.

The main casing 2 accommodates a sheet-feeding unit 4 configured to feed sheets of paper, and an image-forming unit 5 (see FIG. 2) configured to form images on the paper supplied by the sheet-feeding unit 4.

The sheet-feeding unit 4 is disposed at a lower end portion of the main casing 2 and includes a paper tray 9 that accommodates sheets of paper.

The paper tray 9 is removably mounted in a bottom portion of the main casing 2.

Figure 2:
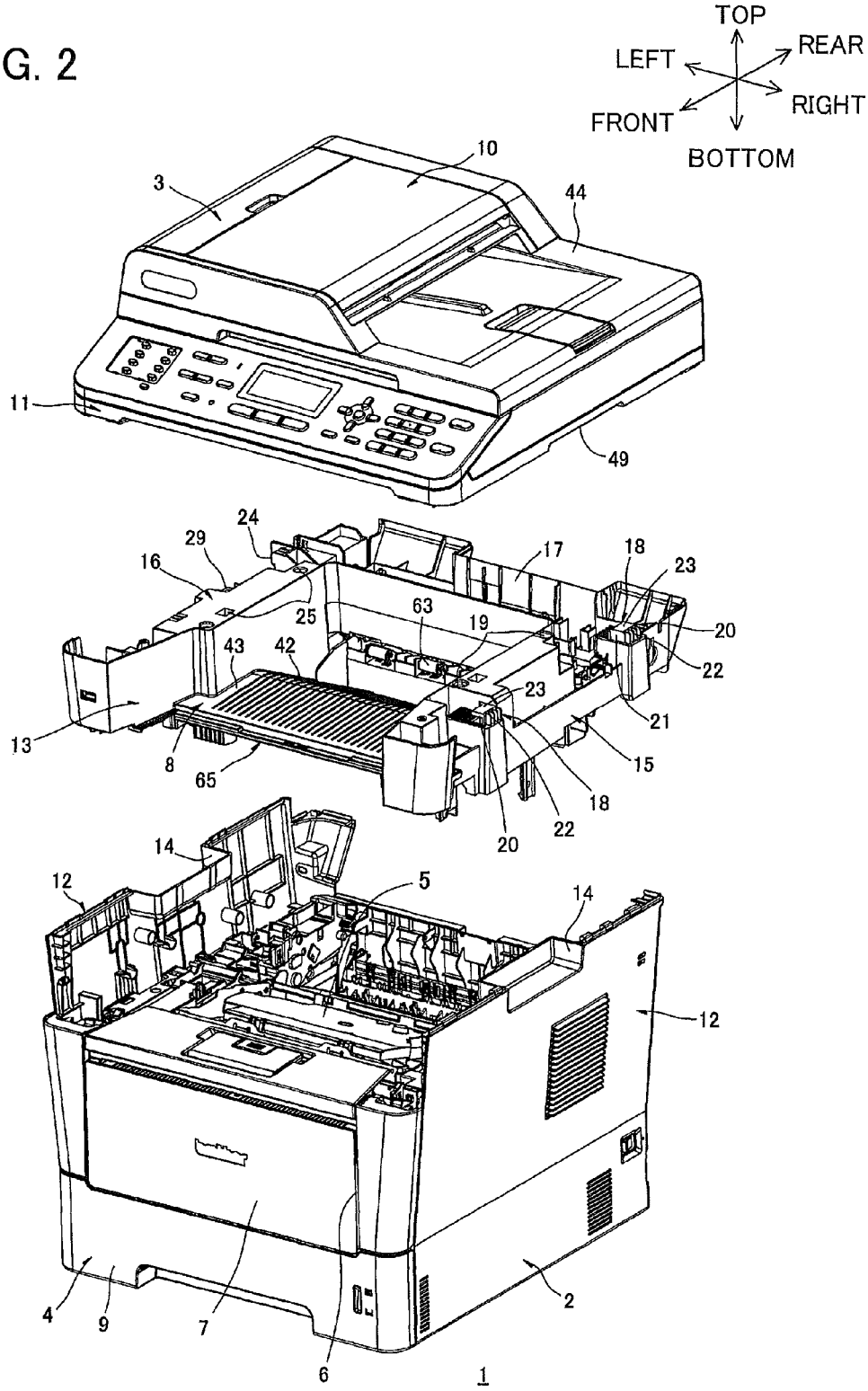
FIG. 2 is an exploded perspective view of the printer of FIG. 1, the printer including a tray-forming member and a support frame.

The image-forming unit 5 is disposed above the sheet-feeding unit 4 (see FIG. 2).

When the sheet-feeding unit 4 supplies a sheet of paper from the paper tray 9 to the image-forming unit 5, the image-forming unit 5 forms an image on the sheet. Subsequently, the sheet is discharged through a discharge opening 63 (see FIG. 2) formed in the main casing 2, and the sheet is received by a discharge tray 8 formed on a top surface of the main casing 2.

The scanning unit 3 is disposed above the main casing 2 and confronts the top surface of the main casing 2 so as to cover the discharge tray 8. The scanning unit 3 is generally rectangular in a plan view and has substantially the same front-rear and left-right dimensions as the main casing 2.

2. Main Casing

As shown in FIGS. 1 and 2, the main casing 2 includes a tray-forming member 13, and a pair of left and right side walls 12.

(1) Detailed Description of the Tray-Forming Member

Figure 3:
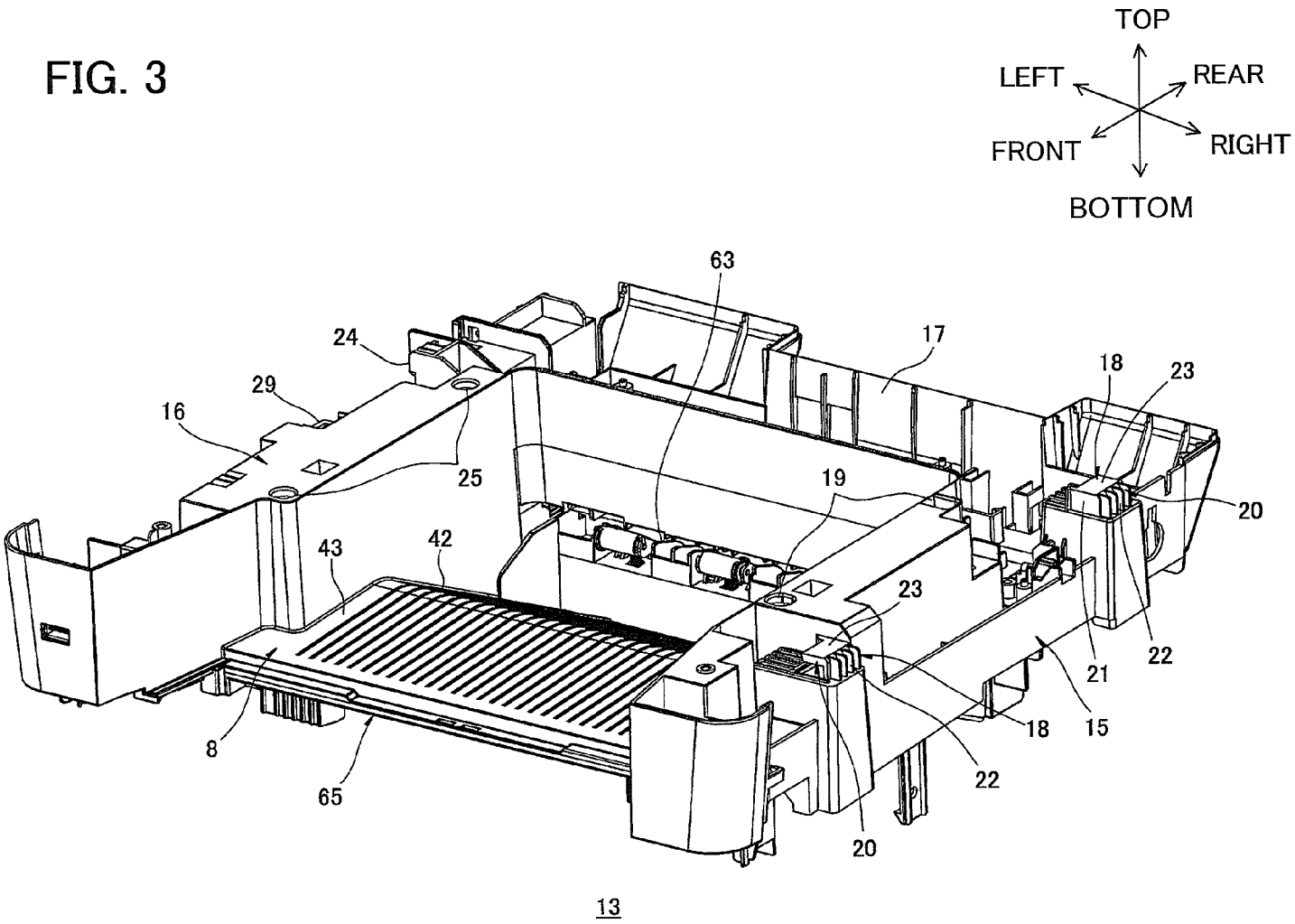
FIG. 3 is a perspective view of the tray-forming member shown in FIG. 2 as viewed from upward and rearward thereof.

The tray-forming member 13 is formed of a resin material and has a generally rectangular frame-like shape in a plan view, as illustrated in FIGS. 2 and 3. More specifically, the tray-forming member 13 is integrally provided with a right wall section 15 and a left wall section 16 arranged parallel to each other and separated in a left-right direction, a rear wall section 17 connecting rear ends of the right wall section 15 and left wall section 16, and a bottom plate 65 surrounded by the right wall section 15, left wall section 16, and rear wall section 17 and connecting lower ends of the right wall section 15 and left wall section 16.

(1-1) Right Wall Section

The right wall section 15 is generally rectangular in a side view and elongated in a front-rear direction. The right wall section 15 includes two body-side hooks 18, and two first boss holes 19.

The two body-side hooks 18 are provided on a right edge of the right wall section 15 so as to be spaced apart from each other in the front-rear direction. Each body-side hook 18 integrally includes a hook-shaped portion 20 and a reinforcing portion 21.

The hook-shaped portion 20 is generally L-shaped in a front view and extends upward from an upper surface of the right wall section 15. More specifically, the hook-shaped portion 20 includes an erect part 22 that extends upward from an upper edge portion of the right wall section 15, and an extended part 23 that extends leftward from an upper end portion of the erect part 22.

The reinforcing portion 21 has a flat plate shape and is generally rectangular in a front view. The reinforcing portion 21 is positioned so as to close a space defined by the upper surface of the right wall section 15, the erect part 22, and the extended part 23 when viewing the hook-shaped portion 20 from the front side. More specifically, the reinforcing portion 21 of the front body-side hook 18 is positioned so as to connect rear edges of the corresponding erect part 22 and extended part 23. The reinforcing portion 21 of the rear body-side hook 18 is positioned so as to connect the front edges of the corresponding erect part 22 and extended part 23.

The two first boss holes 19 are formed in the upper surface of the right wall section 15 near a left edge thereof and are spaced apart in the front-rear direction. More specifically, the front first boss hole 19 is disposed obliquely leftward and rearward of the front body-side hook 18, while the rear first boss hole 19 is disposed obliquely leftward and forward of the rear body-side hook 18.

The front first boss hole 19 is an elongate hole that is elongated in the left-right direction. The front first boss hole 19 has a front-rear dimension approximately equal to a diameter of a corresponding boss 47 (described later), while has a left-right dimension greater than that of the boss 47.

The rear first boss hole 19 is generally rectangular in a plan view and is elongated in the left-right direction. The rear first boss hole 19 has a front-rear dimension approximately equal to the diameter of the corresponding boss 47 (described later), while has a left-right dimension greater than an outer diameter of the boss 47.

(1-2) Left Wall Section

Figure 5:
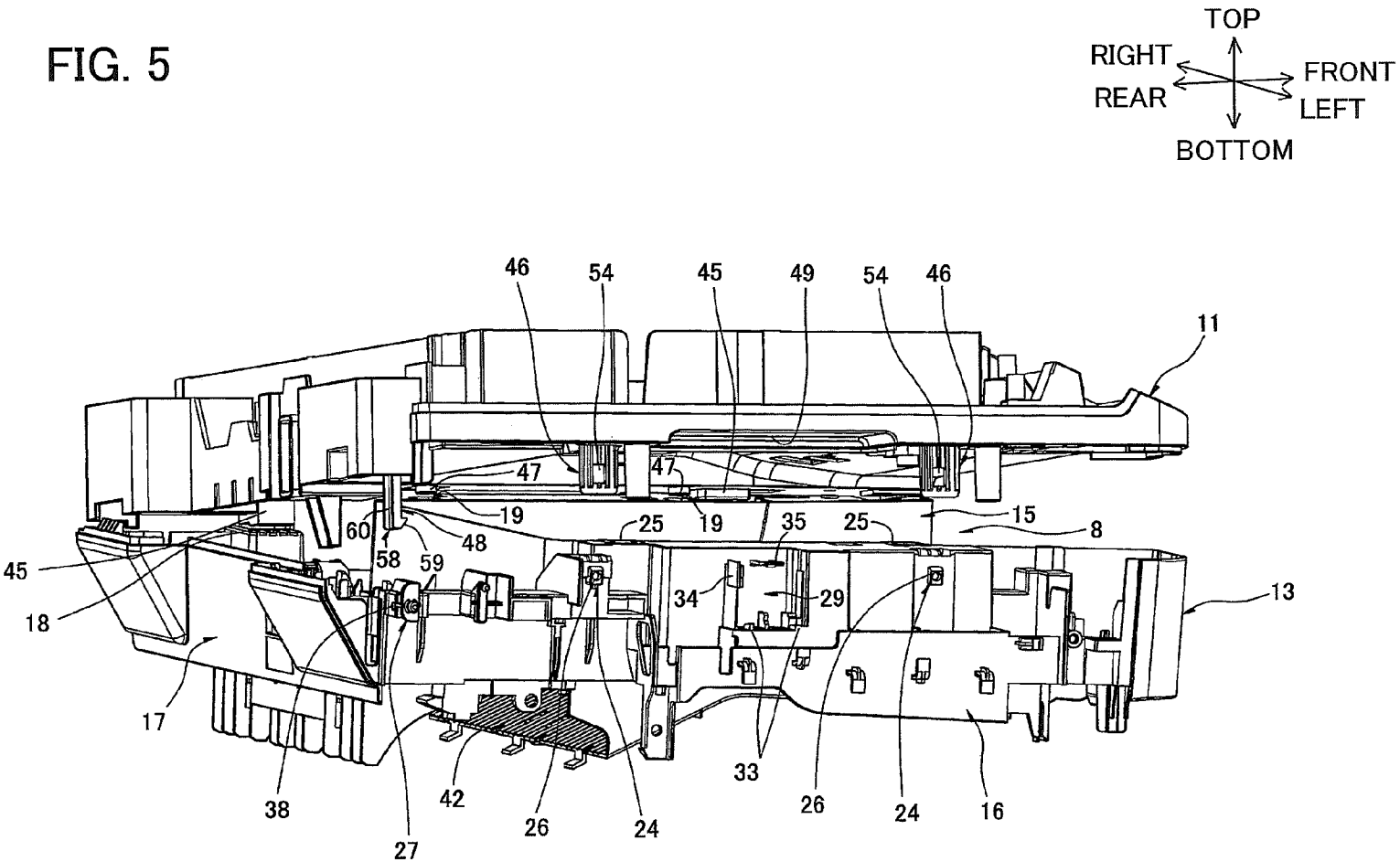
FIG. 5 is an explanatory view showing how the support frame of FIG. 2 is assembled to the tray-forming member of FIG. 2, in which support-frame-side hooks of the support frame are in engagement with body-side hooks of the tray-forming member.

As shown in FIGS. 3 and 5, the left wall section 16 is generally rectangular in a side view and elongated in the front-rear direction. The left wall section 16 has, on its left surface, two snapping protrusions 24 (see FIG. 5), two second boss holes 25, and a retaining part 29 (see FIG. 5).

As shown in FIG. 5, the two snapping protrusions 24 are provided on the left surface of the left wall section 16 and are spaced apart in the front-rear direction. The snapping protrusions 24 have a generally square columnar shape and protrude leftward from the left surface of the left wall section 16. Each snapping protrusion 24 has a top surface that slopes downward toward the left. A screw hole 26 is formed in the center of each snapping protrusion 24.

As shown in FIG. 3, the two second boss holes 25 are formed in the top surface of the left wall section 16 near a right edge thereof and are spaced apart in the front-rear direction. Specifically, the front second boss hole 25 is positioned obliquely rightward and rearward of the front snapping protrusion 24, while the rear second boss hole 25 is positioned obliquely rightward and forward of the rear snapping protrusion 24. Each second boss hole 25 is generally circular in a plan view, and has an inner diameter slightly larger than the outer diameter of the corresponding boss 47 (described later).

Figure 9A:
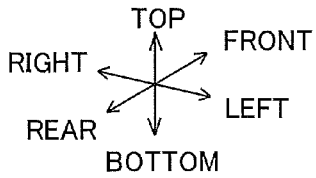
FIG. 9A is an explanatory view showing how a communication circuit board is assembled to a retaining part of the tray-forming member of FIG. 2, in which the communication circuit board is engaged with first engaging portions of the retaining part.
Figure 9A:
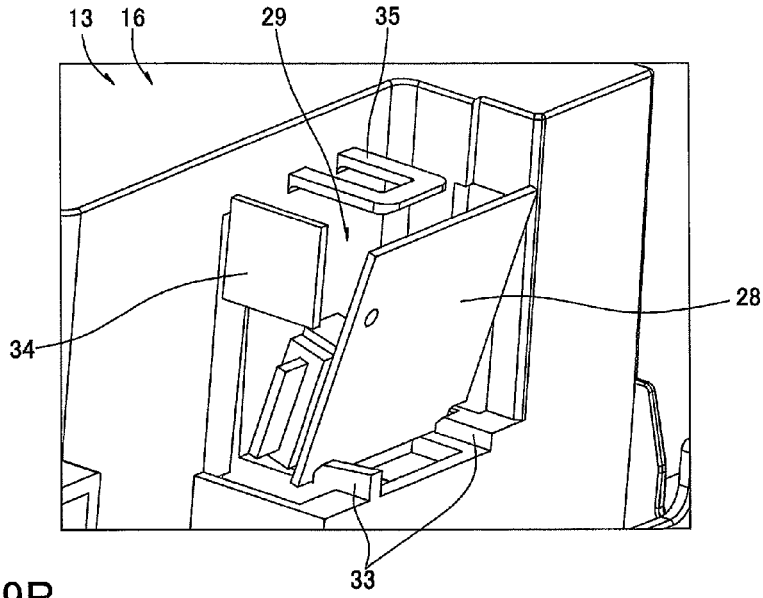

As shown in FIGS. 5 and 9, the retaining part 29 is provided in the left surface of the left wall section 16 at a front-rear center thereof for holding a communication circuit board 28 (described later). The retaining part 29 is generally rectangular in a side view and is depressed rightward (inward) relative to the left surface of the left wall section 16. The retaining part 29 includes two first engaging portions 33, a restricting wall 34, and a second engaging part 35.

The two first engaging portions 33 are provided for engaging a bottom edge of the communication circuit board 28 (described later). The two first engaging portions 33 are spaced apart in the front-rear direction, and protrude upward from a bottom wall of the retaining part 29 near a left end thereof. The first engaging portions 33 have a flat plate shape that is generally rectangular in a side view and elongated in the left-right direction.

The restricting wall 34 serves to restrict movement of a front edge of the communication circuit board 28. The restricting wall 34 has a flat plate shape and is generally rectangular in a rear view. The restricting wall 34 extends leftward from a right wall of the retaining part 29.

The second engaging part 35 is provided for engaging a top edge of the communication circuit board 28. The second engaging part 35 has a flat plate shape and is generally rectangular in a plan view. The second engaging part 35 protrudes leftward from the right wall of the retaining part 29. A hole is formed in a front-rear center region of the second engaging part 35 and is elongated in the left-right direction. The second engaging part 35 is disposed above the bottom wall of the retaining part 29 so as to be separated from the same by a distance equivalent to a height of the communication circuit board 28 (described later).

(1-3) Rear Wall Section

As shown in FIGS. 3 and 5, the rear wall section 17 is generally rectangular in a plan view and elongated in the left-right direction. The rear wall section 17 has a left surface from which a snap-receiving part 27 protrudes leftward. Specifically, the snap-receiving part 27 is formed on the left surface at a position adjacent to a left and rear edge thereof.

The snap-receiving part 27 has a square pillar shape and is generally rectangular in a rear view. The snap-receiving part 27 has a thickness in the front-rear direction and has a rear surface in which a screw hole 38 is formed to penetrate therethrough in the front-rear direction.

(1-4) Bottom Plate

As shown in FIG. 3, the bottom plate 65 is generally rectangular in a plan view and includes a sloping part 42, and a level part 43.

The sloping part 42 is generally rectangular in a plan view and slopes downward toward the rear (toward the image-forming unit 5) from an approximate front-rear center portion of the bottom plate 65.

The level part 43 is generally rectangular in a plan view and extends forward from the approximate front-rear center portion of the bottom plate 65.

The right wall section 15, left wall section 16, rear wall section 17, and bottom plate 65 constitute the discharge tray 8.

(2) Detailed Description of the Side Walls

The side walls 12 are formed of a resin material. As shown in FIGS. 1 and 2, the side walls 12 have a flat plate-like shape and are generally rectangular in a side view. The side walls 12 are arranged parallel to each other and are spaced apart in the left-right direction for covering the respective left and right sides of the image-forming unit 5 and tray-forming member 13. The tray-forming member 13 is provided so as to link upper end portions of the side walls 12. Top edges of the side walls 12 are substantially flush with the top edges of the tray-forming member 13.

A recessed part 14 is formed in a top end portion of each side wall 12 at a position center thereof in the front-rear direction. In a plan view, the recessed parts 14 have a general U-shape that opens on the respective left or right outer side thereof. The recessed parts 14 are depressed inward relative to outer surfaces of the corresponding side walls 12. The recessed parts 14 are also open on the top.

3. Scanning Unit

The scanning unit 3 includes an image-reading unit 10, and a support frame 11 that supports the image-reading unit 10 on its bottom, as shown in FIG. 2.

The image-reading unit 10 reads image data of an original after the original is placed between an original cover 44 and a glass surface (not shown).

Figure 4:
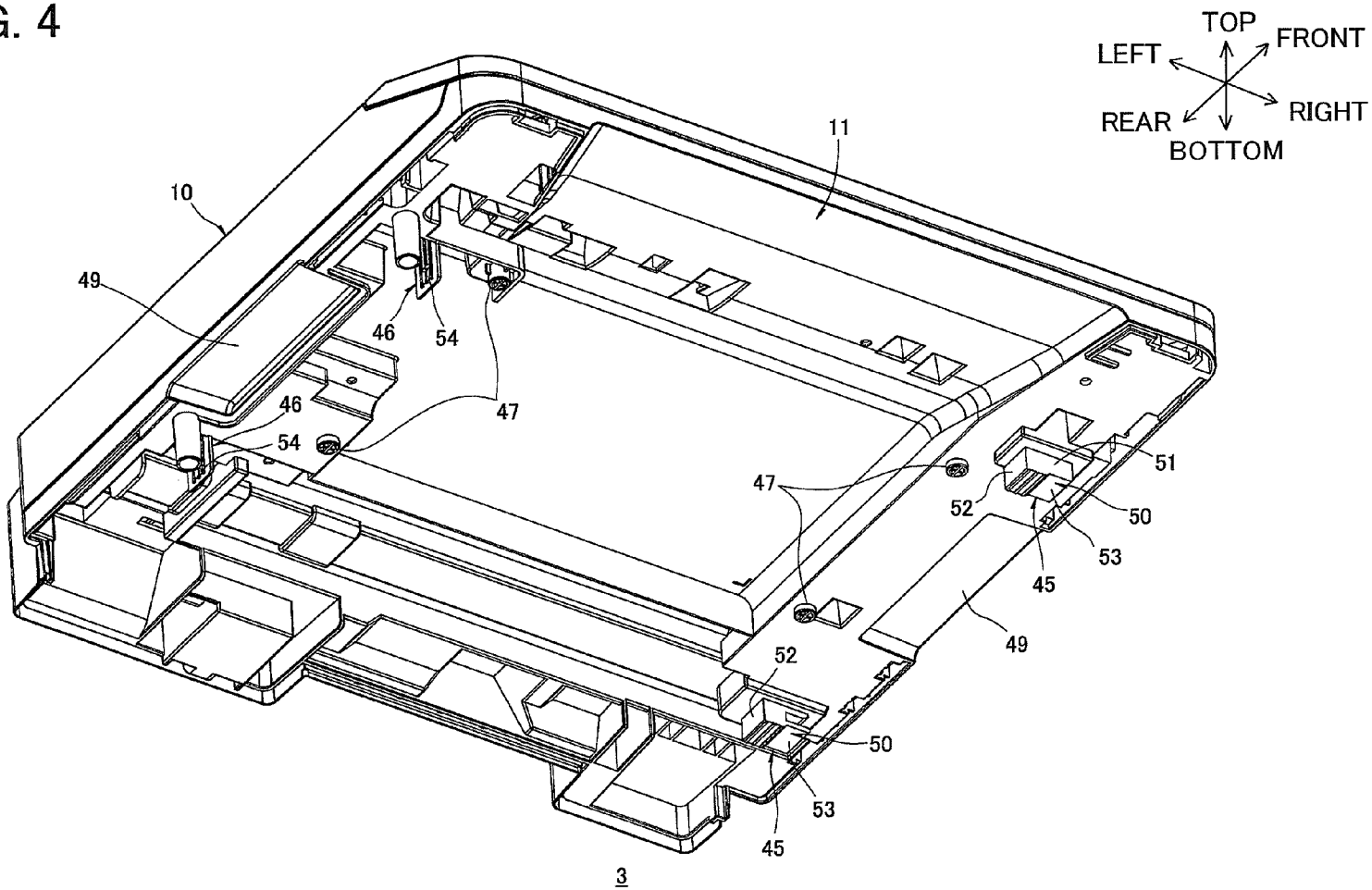
FIG. 4 is a perspective view of the support frame shown in FIG. 2 as viewed from below and leftward thereof.

As shown in FIG. 4, the support frame 11 has a flat plate-like shape and is generally rectangular in a plan view. The support frame 11 includes two support-frame-side hooks 45, two recessed snap parts 46, a snap hook part 48 (see FIG. 5), four bosses 47, and two grip parts 49.

(1) Detailed Description of the Support-Frame-Side Hooks

The two support-frame-side hooks 45 are provided on a bottom surface of the support frame 11 near the right edge thereof, and are spaced apart from each other in the front-rear direction. Each support-frame-side hook 45 is integrally provided with a hook-shaped portion 50, and a reinforcing portion 51.

The hook-shaped portion 50 is generally L-shaped in a front view. Specifically, the hook-shaped portion 50 includes an erect part 52 extending downward from the bottom surface of the support frame 11 near the right edge thereof, and an extended part 53 that extends rightward from a bottom edge of the erect part 52.

The reinforcing portion 51 has a flat plate shape and is generally rectangular in a front view. The reinforcing portion 51 is disposed so as to close a space defined by the bottom surface of the support frame 11, the erect part 52, and the extended part 53 when viewing the hook-shaped portion 50 from the front side. More specifically, the reinforcing portion 51 of the front support-frame-side hook 45 is arranged so as to connect front edges of the erect part 52 and the extended part 53 constituting the front support-frame-side hook 45, while the reinforcing portion 51 of the rear support-frame-side hook 45 is arranged so as to connect rear edges of the erect part 52 and the extended part 53 constituting the rear support-frame-side hook 45.

(2) Detailed Description of the Recessed Snap Parts

The two recessed snap parts 46 are disposed on the bottom surface of the support frame 11 near the left edge thereof and are spaced away from each other in the front-rear direction. The recessed snap parts 46 have a flat plate shape and are generally rectangular in a side view. The recessed snap parts 46 extend downward from the bottom surface of the support frame 11. The recessed snap parts 46 are so configured as to be resiliently deformable in the left-right direction. A first through-hole 54 is formed in a bottom end portion of each recessed snap parts 46 at a position center thereof in the front-rear direction. The recessed snap parts 46 are capable of receiving the corresponding snapping protrusions 24.

(3) Detailed Description of the Bosses

The four bosses 47 are provided on the bottom surface of the support frame 11 and are spaced apart in the front-rear and left-right directions, forming four corners of a rectangle. The bosses 47 are generally columnar in shape and protrude downward from the bottom surface of the support frame 11.

More specifically, the right-front boss 47 is disposed obliquely leftward and rearward of the front support-frame-side hook 45; the right-rear boss 47 is disposed obliquely leftward and forward of the rear support-frame-side hook 45; the left-front boss 47 is disposed obliquely rightward and rearward of the front recessed snap parts 46; and the left-rear boss 47 is disposed obliquely rightward and forward of the rear recessed snap parts 46.

In other words, when projected vertically, all the bosses 47 are arranged to fall within an imaginary rectangular area defined by the two support-frame-side hooks 45 and the two recessed snap parts 46 as four corners of a rectangle. Alternatively, if more than three support-frame-side hooks 45 and more than three recessed snap parts 46 are provided, the imaginary rectangular area is defined by two outermost support-frame-side hooks 45 and two outermost recessed snap parts 46 as four outermost corners of a rectangle.

(4) Detailed Description of the Snap Hook Part

As shown in FIG. 5, the snap hook part 48 is generally L-shaped in a side view. Specifically, the snap hook part 48 includes a leg part 58 that extends downward from the bottom surface of the support frame 11 near the left-rear corner thereof, and a pawl part 59 that extends forward from a bottom edge of the leg part 58.

The leg part 58 has a flat plate shape and is generally rectangular in a plan view. The leg part 58 is so configured as to be resiliently deformable in the front-rear direction. A second through-hole 60 is formed in a bottom end portion of the leg part 58, penetrating the leg part 58 in the front-rear direction.

In a side view, the pawl part 59 is generally shaped like a right triangle, with one vertex pointing forward and its top side aligned in the front-rear direction.

(5) Detailed Description of the Grip Parts

As shown in FIG. 4, the grip parts 49 are provided one on each of the left and right edges of the support frame 11 and are positioned in the front-rear center thereof. The grip parts 49 are generally rectangular in a bottom view and are recessed upward relative to the bottom surface of the support frame 11 to allow the user to grip the support frame 11.

4. Assembling the Scanning Unit to the Main Casing

Next, how the scanning unit 3 is assembled to the main casing 2 will be described with reference to FIGS. 2 and 5-8. In the following description of this assembly, detailed descriptions will be provided for the tray-forming member 13 of the main casing 2 and the support frame 11 of the scanning unit 3.

Figure 8:
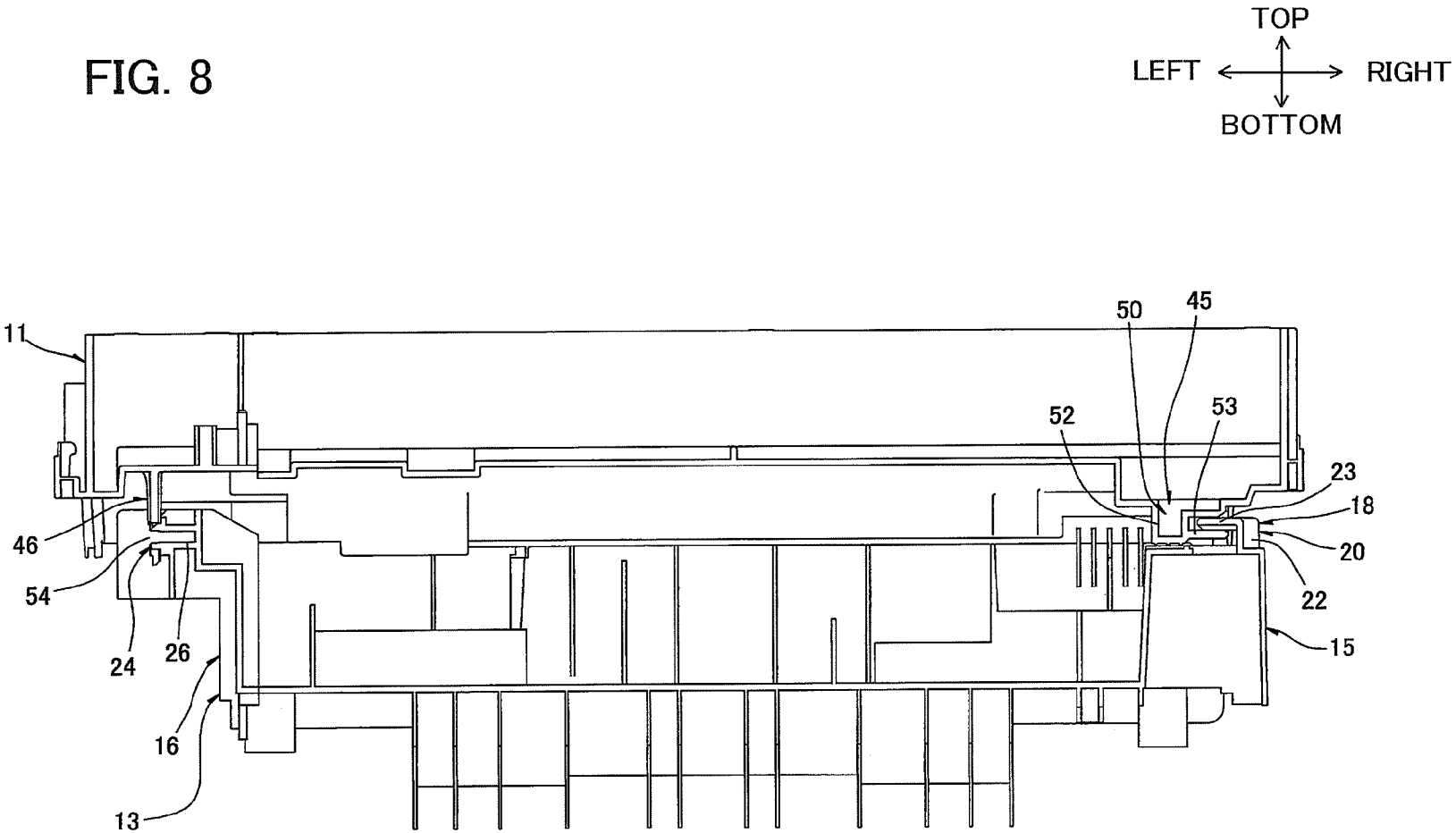
FIG. 8 is a vertical cross-sectional view of the tray-forming member and the support frame of FIG. 6.

To assemble the scanning unit 3 onto the main casing 2, first the operator positions the scanning unit 3 over the main casing 2, as shown in FIG. 2. Next, the operator tilts the right side of the support frame 11 downward, as shown in FIG. 5, and engages the support-frame-side hooks 45 with the body-side hooks 18 such that the hook-shaped portions 50 of the support-frame-side hooks 45 are fitted into the hook-shaped portions 20 of the body-side hooks 18, as shown in FIG. 8.

Next, the operator pivots the support frame 11 about its right edge so that the left side moves downward. As the support frame 11 pivots, the two bosses 47 disposed on the right side of the support frame 11 are fitted into the corresponding first boss holes 19. At this point, the support frame 11 is sloped relative to the tray-forming member 13 so that the bosses 47 engage in the first boss holes 19 in a slanted state. Since the first boss holes 19 are elongated in the left-right direction, the first boss holes 19 can smoothly receive the bosses 47 in their slanted state.

As the support frame 11 is pivoted further about its right edge, the two bosses 47 disposed on the left side of the support frame 11 engage in the two second boss holes 25. Since the support frame 11 is substantially parallel to the tray-forming member 13 at this time, the bosses 47 engage in the second boss holes 25 in a state substantially vertically thereto.

As the support frame 11 pivots further about its right edge, the recessed snap parts 46 contact the snapping protrusions 24 from leftward thereof, and the pawl part 59 of the snap hook part 48 contacts the snap-receiving part 27 from rearward thereof. As a result, the recessed snap parts 46 deform resiliently leftward by a distance equivalent to a protruding length of the snapping protrusions 24. As the support frame 11 continues to pivot, the first through-holes 54 in the recessed snap parts 46 become aligned with the snapping protrusions 24 in the left-right direction. At this time, the recessed snap parts 46 are allowed to return to their original state, with the snapping protrusions 24 received in the first through-holes 54 of the recessed snap parts 46.

Figure 7:
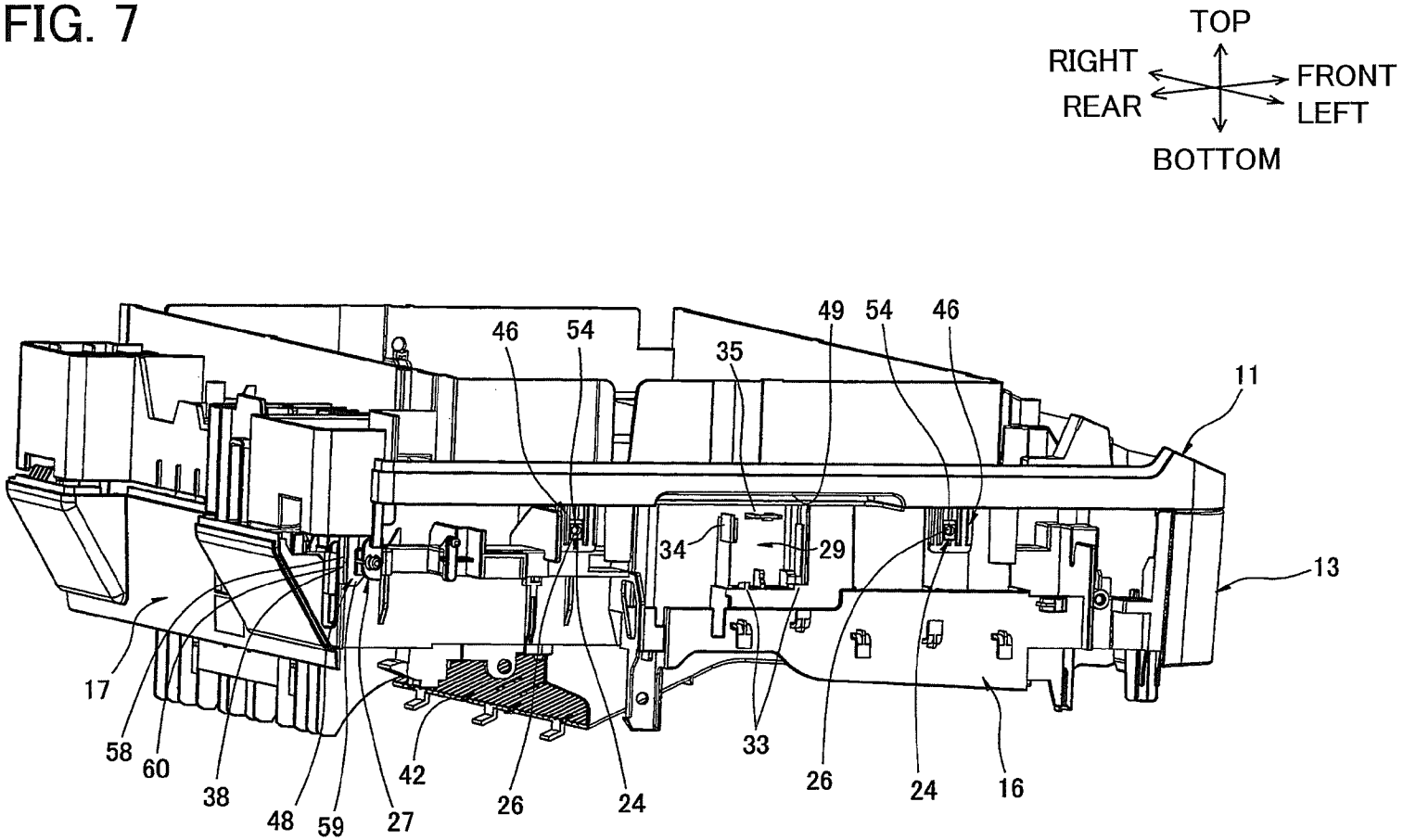
FIG. 7 is a perspective view of the tray-forming member and the support frame of FIG. 6 as viewed from rearward and leftward thereof.

At the same time, the snap hook part 48 resiliently deforms rearward, on its leg part 58, by a distance equivalent to a protruding length of the pawl part 59. As the support frame 11 continues to pivot, the leg part 58 of the snap hook part 48 returns to its original state, with the pawl part 59 of the snap hook part 48 positioned beneath the snap-receiving part 27. Through this operation, the recessed snap parts 46 are engaged with the corresponding snapping protrusions 24 and the snap hook part 48 is engaged with the snap-receiving part 27, as illustrated in FIGS. 7 and 8.

The operator completes assembly of the scanning unit 3 on the main casing 2 by threading a screw (not shown) into the screw hole 38 of the snap-receiving part 27 via the second through-hole 60 and by threading screws (not shown) into the screw holes 26 of the snapping protrusions 24. At this time, the grip parts 49 are positioned opposite the recessed parts 14 vertically, as shown in FIG. 1.

5. Assembling the Communication Circuit Board in the Retaining Part

Next, mounting of the communication circuit board 28 in the retaining part 29 of the tray-forming member 13 will be described. The communication circuit board 28 is a wireless LAN circuit board that functions to communicate with an external personal computer.

Figure 9B:
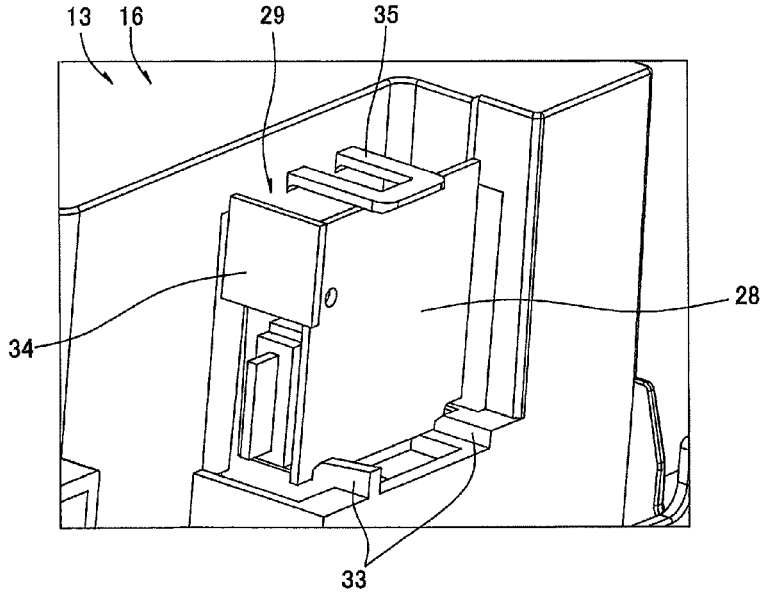
FIG. 9B is an explanatory view showing how the communication circuit board is assembled to the retaining part of the tray-forming member of FIG. 2, in which the communication circuit board has been assembled to the retaining part.

As shown in FIG. 9, the communication circuit board 28 has a substantially rectangular flat plate shape. To mount the communication circuit board 28 in the retaining part 29, the operator places the bottom edge of the communication circuit board 28 in contact with the bottom wall of the retaining part 29, as shown in FIG. 9A, so that the bottom edge of the communication circuit board 28 is engaged in the first engaging portions 33 provided on the bottom wall of the retaining part 29. With the communication circuit board 28 engaged in the first engaging portions 33, the operator then presses the communication circuit board 28 toward the left wall 16 so that the communication circuit board 28 is engaged with the restricting wall 34 and second engaging part 35, as shown in FIG. 9B. This completes the process of assembling the communication circuit board 28 in the retaining part 29.

6. Operations and Technical Advantages (1) In the printer 1 of the first embodiment described above, the right end of the main casing 2 is fixed to the right end of the support frame 11 by engaging the body-side hooks 18 with the support-frame-side hooks 45, as shown in FIG. 8. Further, the left end of the main casing 2 is fixed to the left end of the support frame 11 by engaging the snapping protrusions 24 in the recessed snap parts 46, as shown in FIG. 5.

Therefore, if the user grips the printer 1 by the grip parts 49 provided in the support frame 11, this configuration can minimize shifting or rattling between the main casing 2 and support frame 11, at least in the left-right direction. In this way, this structure of the first embodiment can suppress the amount of load applied to engaging portions (the support-frame-side hooks 45 and recessed snap parts 46) and engaged portions (the body-side hooks 18 and snapping protrusions 24) caused by shifting or rattling between the main casing 2 and support frame 11.

Figure 6:
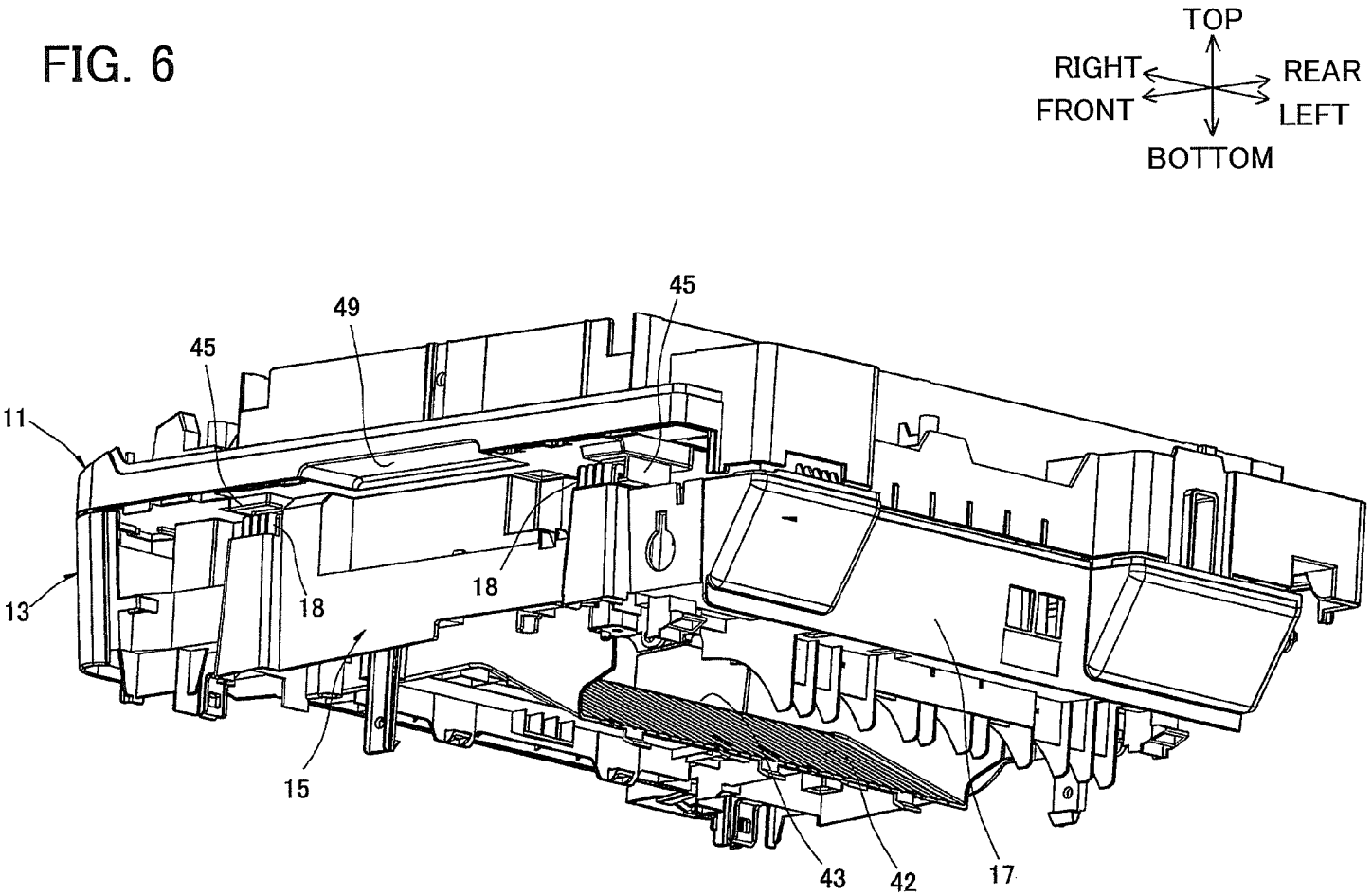
FIG. 6 is a perspective view of the tray-forming member and the support frame as viewed from rearward and rightward thereof.

(2) As shown in FIGS. 6 and 7, the support frame 11 of the present embodiment is provided with the support-frame-side hooks 45 and recessed snap parts 46, and the tray-forming member 13 is provided with the body-side hooks 18 and snapping protrusions 24.

Hence, through a simple construction, it is possible to engage the body-side hooks 18 with the support-frame-side hook 45 and the snapping protrusions 24 with the recessed snap parts 46, making it possible to assemble the support frame 11 to the main casing 2 through a simple construction.

(3) As shown in FIGS. 3 and 4, the support-frame-side hooks 45 on the support frame 11 include the reinforcing portions 51, and the body-side hooks 18 on the main casing 2 include the reinforcing portions 21.

With this construction, when the printer 1 is lifted upward by the grip parts 49, the reinforcing portions 51 can minimize the amount that the extended parts 53 on the support frame 11 deform toward the main casing 2, while the reinforcing portions 21 can minimize the amount that the extended parts 23 on the main casing 2 deform toward the support frame 11. Accordingly, this construction ensures that the main casing 2 follows movement of the support frame 11 when the user lifts the printer 1 by gripping the support frame 11.

(4) As shown in FIGS. 3 and 4, the support frame 11 is provided with the bosses 47, while the main casing 2 is provided with the boss holes 19 and 25. This configuration can further reduce shifting or rattling between the main casing 2 and support frame 11 through the engagement between the bosses 47 and the boss holes 19 and 25.

(5) As shown in FIG. 4, two of the four bosses 47 are formed on the left side of the support frame 11. These bosses 47 can better suppress shifting or rattling between the main casing 2 and support frame 11 near the snapping protrusions 24 and recessed snap parts 46.

Accordingly, this configuration reduces the amount of load applied to the snapping protrusions 24 and recessed snap parts 46 due to shifting and rattling between the support frame 11 and main casing 2, preventing damage to the snapping protrusions 24 and recessed snap parts 46.

(6) The printer 1 of the first embodiment can prevent shifting or rattling between the main casing 2 and the support frame 11 with the body-side hooks 18 and the recessed snap parts 46 disposed on outer sides of the printer 1 in the left-right direction, while the bosses 47 provided on inner sides of the printer 1 in the left-right direction (inward of the body-side hooks 18 and recessed snap parts 46) can partially absorb the load applied to the body-side hooks 18 and recessed snap parts 46 (load in left-right direction).

Thus, this construction can suppress shifting or rattling between the main casing 2 and support frame 11 while preventing damage to the body-side hooks 18 and recessed snap parts 46.

(7) The printer 1 of the first embodiment is further provided with the snap hook part 48 disposed on the rear side of the support frame 11 and the snap-receiving part 27 disposed on the rear side of the main casing 2.

This structure can also suppress shifting or rattling between the main casing 2 and support frame 11 in the front-rear direction.

(8) As shown in FIGS. 1 and 2, the main casing 2 is provided with the pair of side walls 12 disposed on the left and right sides of the image-forming unit 5, respectively, and the tray-forming member 13 linking the side walls 12. By linking the side walls 12 with the tray-forming member 13 in this way, this configuration improves rigidity of the main casing 2.

(9) As shown in FIG. 9, the printer 1 includes the retaining part 29 for retaining the communication circuit board 28. Attachment of the communication circuit board 28 to the tray-forming member 13 can be easily done. Also, such location of the communication circuit board 28 between the image-forming unit 5 and image-reading unit 10 is efficient in terms of installation of electrical wirings.

7. Second Embodiment

Figure 10:
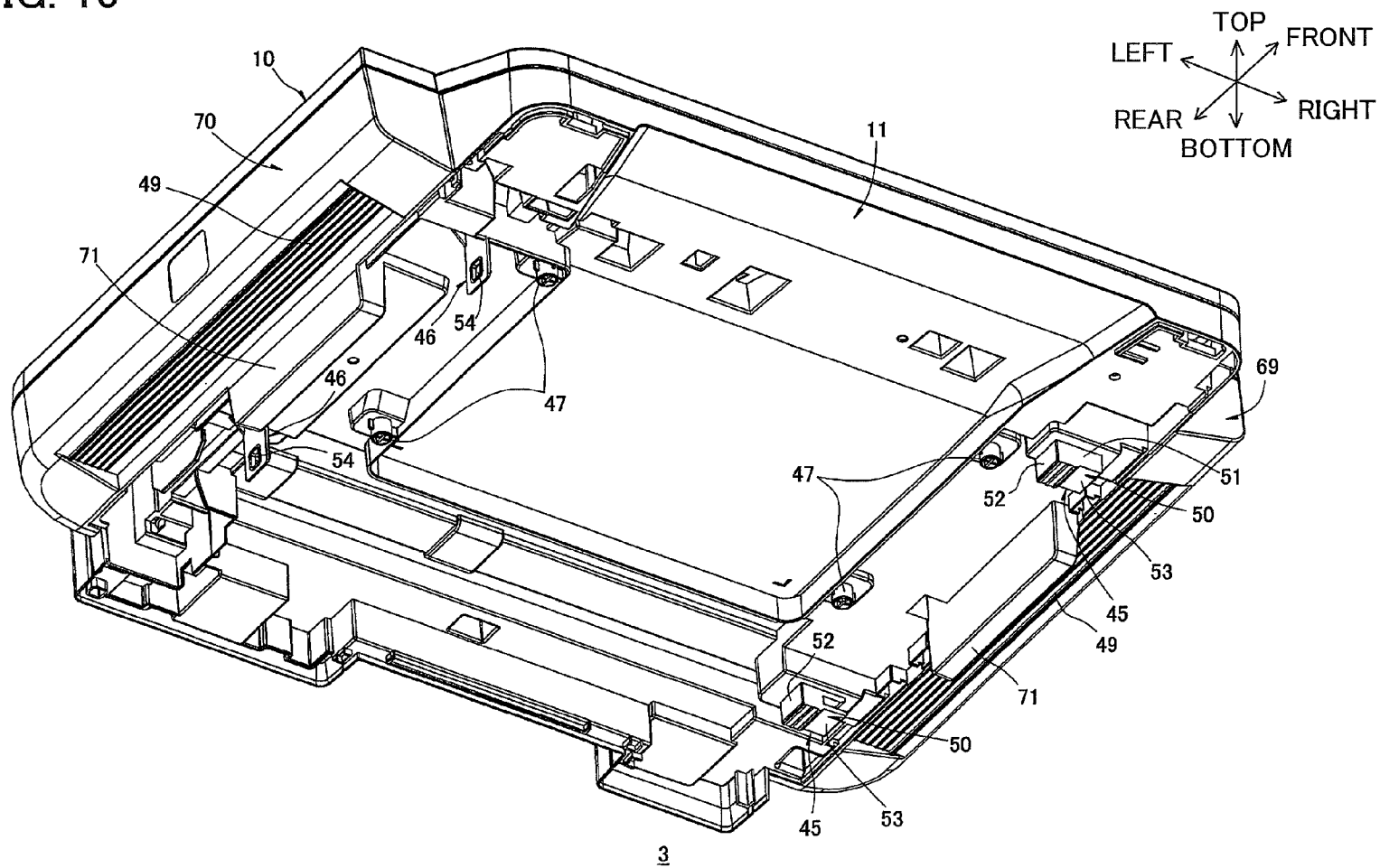
FIG. 10 is a perspective view of a support frame according to a second embodiment of the present invention as viewed from below and leftward thereof.

A scanning unit 203 according to a second embodiment of the present invention will be described next with reference to FIG. 10, wherein like parts and components are designated with the same reference numerals as those of the first embodiment to avoid duplicating description.

In the first embodiment described above, the support frame 11 is formed in a size substantially the same as that of the main casing 2 in a plan view, and the grip parts 49 are formed in the left and right edges of the support frame 11. The grip parts 49 are positioned so as to confront the recessed parts 14 formed in the side walls 12 when the scanning unit 3 is assembled on the main casing 2 (see FIG. 1).

A support frame 211 according to the second embodiment is provided with a right protruding part 69 that protrudes rightward from a right edge of the support frame 211, and a left protruding part 70 that protrudes leftward from a left edge of the support frame 211. Grip parts 249 are provided on bottom surfaces of the right protruding part 69 and left protruding part 70, extending in the front-rear direction along these bottom surfaces.

The support frame 211 also includes two fitting parts 71 provided on its bottom surface. The two fitting parts 71 are formed one on each of the left and right sides of the support frame 211 at positions for fitting into the recessed parts 14 formed in the corresponding side walls 12 when the scanning unit 203 is assembled on the main casing 2. The fitting parts 71 are generally rectangular in a side view and protrude downward from the bottom surface of the support frame 211.

The fitting parts 71 have a thick plate shape with a substantial thickness in the left-right direction.

When the scanning unit 203 is assembled on the main casing 2, the fitting parts 71 are fitted inside the recessed parts 14, with the right protruding part 69 and left protruding part 70 protruding outward (rightward and leftward respectively) from the main casing 2 in right-left direction.

With this construction of the support frame 211, the user can lift up the printer 1 stably with regard to the left-right direction by gripping the grip parts 249 of the right protruding part 69 and left protruding part 70.

Further, the construction of the second embodiment can also achieve technical advantages the same as those of the first embodiment.

While the invention has been described in detail with reference to the embodiments thereof, it would be apparent to those skilled in the art that various changes and modifications may be made therein without departing from the spirit of the invention.

For example, in the depicted embodiments, the support-frame-side hooks 45 and the body-side hooks 18 (claimed first engaging portion and first engaged portion respectively) are formed on the right side of the printer 1, while the recessed snap parts 46 and the snapping protrusions 24 (claimed second engaging portion and second engaged portion) are formed on the left side of the printer 1. However, these engaging portions and engaged portions may not necessarily be provided at the left/right sides of the printer 1, but may be provided at the front/rear sides of the printer 1. That is, the first engaging portion and the first engaged portion (the support-frame-side hooks 45 and the body-side hooks 18) may be formed at either one of the front side and the rear side of the printer 1, while the second engaging portion and the second engaged portion (the recessed snap parts 46 and the snapping protrusions 24) may be formed on remaining one side of the printer 1 (either the front side or the rear side). If this is the case, claimed third engaging portion and third engaged portion (the snap hook part 48 and the snap-receiving part 27) should be provided either at the right side or at the left side of the printer 1. With this construction as well, the printer 1 can suppress shifting and rattling between the support frame 11 and the main casing 2 in the front-rear direction as well as in the left-right direction.

What is claimed is:

1. An image forming apparatus comprising:

an image forming unit configured to form images;

an image reading unit configured to read images of an original;

a body frame accommodating the image forming unit therein; and a support frame supporting the image reading unit and disposed to confront the body frame in a confronting direction, the support frame having a first end portion and a second end portion opposite to each other in a first direction perpendicular to the confronting direction, the support frame including:

a first engaging portion provided at the first end portion, the first engaging portion comprising:

a first erect part extending from the first end portion toward the body frame; and a first extending part extending from the first erect part away from the second end portion in the first direction;

a second engaging portion provided at the second end portion; and a pair of grip portions each provided at each of the first end portion and the second end portion, wherein the body frame has a first edge portion and a second edge portion opposite to each other in the first direction, the first edge portion and the second edge portion confronting the first end portion and the second end portion respectively when the support frame is assembled to the body frame, the body frame including:

a first engaged portion provided at the first edge portion and configured to be engaged with the first engaging portion, the first engaged portion comprising:

a second erect part extending from the first edge portion toward the support frame; and a second extending part extending from the second erect part toward the second edge portion in the first direction; and a second engaged portion provided at the second edge portion and configured to be engaged with the second engaging portion.

2. The image forming apparatus according to claim 1, wherein the first engaging portion further includes a first reinforcing part connecting the first extending part and the first end portion together, and wherein the first engaged portion further includes a second reinforcing part connecting the second extending part and the first edge portion together.

3. The image forming apparatus according to claim 1, wherein the support frame has a third end portion and a fourth end portion opposite to each other in a second direction perpendicular to the confronting direction and the first direction, the support frame further comprising a third engaging portion disposed on one of the third end portion and the fourth end portion and configured to be deformable in the second direction, and wherein the body frame has a third edge portion and a fourth edge portion opposite to each other in the second direction, the body frame further comprising a third engaged portion disposed on one of the third edge portion and the fourth edge portion and configured to be engaged with the third engaging portion.

4. An image forming apparatus comprising:

an image forming unit configured to form images;

an image reading unit configured to read images of an original;

a body frame accommodating the image forming unit therein; and a support frame supporting the image reading unit and disposed to confront the body frame in a confronting direction, the support frame having a first end portion and a second end portion opposite to each other in a first direction perpendicular to the confronting direction, the support frame including:

a first engaging portion provided at the first end portion;

a second engaging portion provided at the second end portion;

a pair of grip portions each provided at each of the first end portion and the second end portion; and a protruding portion protruding toward the body frame, wherein the body frame has a first edge portion and a second edge portion opposite to each other in the first direction, the first edge portion and the second edge portion confronting the first end portion and the second end portion respectively when the support frame is assembled to the body frame, the body frame including:

a first engaged portion provided at the first edge portion and configured to be engaged with the first engaging portion;

a second engaged portion provided at the second edge portion and configured to be engaged with the second engaging portion; and wherein the body frame further includes a fitting hole with which the protruding portion is engaged when the support frame is assembled to the body frame.

5. The image forming apparatus according to claim 4, wherein the protruding portion is formed at the second end portion of the support frame.

6. The image forming apparatus according to claim 4, wherein the protruding portion comprises a plurality of protrusions spaced away from one another and aligned in the first direction and in a second direction perpendicular to the confronting direction and the first direction.

7. The image forming apparatus according to claim 6, wherein the first engaging portion comprises a plurality of first engaging parts aligned in the second direction, an outermost one of the first engaging parts in the second direction being a first outer engaging part and another one of the first engaging parts positioned farthest from the first outer engaging part in the second direction being a first opposing engaging part, wherein the second engaging portion comprises a plurality of second engaged parts aligned in the second direction, an outermost one of the second engaging parts in the second direction being a second outer engaging part and another one of the second engaging parts positioned farthest from the second outer engaging part in the second direction being a second opposing engaging part, and wherein the plurality of protrusions are positioned between the first outer engaging part and the second outer engaging part and also between the first opposing engaging part and the second opposing engaging part in the first direction, and between the first outer engaging part and the first opposing engaging part and also between the second outer engaging part and the second opposing engaging part in the second direction.

8. The image forming apparatus according to claim 4, wherein the support frame has a third end portion and a fourth end portion opposite to each other in a second direction perpendicular to the confronting direction and the first direction, the support frame further comprising a third engaging portion disposed on one of the third end portion and the fourth end portion and configured to be deformable in the second direction, and wherein the body frame has a third edge portion and a fourth edge portion opposite to each other in the second direction, the body frame further comprising a third engaged portion disposed on one of the third edge portion and the fourth edge portion and configured to be engaged with the third engaging portion.

9. An image forming apparatus comprising:

an image forming unit configured to form images;

an image reading unit configured to read images of an original;

a body frame accommodating the image forming unit therein; and a support frame supporting the image reading unit and disposed to confront the body frame in a confronting direction, the support frame having a first end portion and a second end portion opposite to each other in a first direction perpendicular to the confronting direction, the support frame including:

a first engaging portion provided at the first end portion;

a second engaging portion provided at the second end portion and comprising an engaging part extending toward the body frame from the second end portion, the engaging part having an opening formed therein and penetrating therethrough in the first direction; and a pair of grip portions each provided at each of the first end portion and the second end portion, wherein the body frame has a first edge portion and a second edge portion opposite to each other in the first direction, the first edge portion and the second edge portion confronting the first end portion and the second end portion respectively when the support frame is assembled to the body frame, the body frame including:

a first engaged portion provided at the first edge portion and configured to be engaged with the first engaging portion; and a second engaged portion provided at the second edge portion and configured to be engaged with the second engaging portion, the second engaged portion including an engaged part configured to be engaged with the engaging part of the second engaging portion, wherein the engaged part is in a form of a rib protruding from the second edge portion away from the first edge portion in the first direction, the rib being configured to be inserted into the opening to provide engagement between the engaging part and the engaged part.

10. The image forming apparatus according to claim 9, wherein the engaging part is configured to be deformable in the first direction to allow the opening to be engaged with the rib.

11. The image forming apparatus according to claim 9, wherein the support frame has a third end portion and a fourth end portion opposite to each other in a second direction perpendicular to the confronting direction and the first direction, the support frame further comprising a third engaging portion disposed on one of the third end portion and the fourth end portion and configured to be deformable in the second direction, and wherein the body frame has a third edge portion and a fourth edge portion opposite to each other in the second direction, the body frame further comprising a third engaged portion disposed on one of the third edge portion and the fourth edge portion and configured to be engaged with the third engaging portion.

12. An image forming apparatus comprising:

an image forming unit configured to form images;

an image reading unit configured to read images of an original;

a body frame accommodating the image forming unit therein; and a support frame supporting the image reading unit and disposed to confront the body frame in a confronting direction, the support frame having a first end portion and a second end portion opposite to each other in a first direction perpendicular to the confronting direction, the support frame including:

a first engaging portion provided at the first end portion;

a second engaging portion provided at the second end portion; and a pair of grip portions each provided at each of the first end portion and the second end portion, a third end portion;

a fourth end portion opposite to the third end portion in a second direction perpendicular to the confronting direction and the first direction; and a third engaging portion disposed on one of the third end portion and the fourth end portion and configured to be deformable in the second direction, wherein the body frame has a first edge portion and a second edge portion opposite to each other in the first direction, the first edge portion and the second edge portion confronting the first end portion and the second end portion respectively when the support frame is assembled to the body frame, the body frame including:

a first engaged portion provided at the first edge portion and configured to be engaged with the first engaging portion;

a second engaged portion provided at the second edge portion and configured to be engaged with the second engaging portion, a third edge portion and;

a fourth edge portion opposite to the third edge portion in the second direction; and a third engaged portion disposed on one of the third edge portion and the fourth edge portion and configured to be engaged with the third engaging portion.

13. The image forming apparatus according to claim 12, wherein the first end portion includes a first protruding portion protruding outward than the first edge portion in the first direction when the support frame is assembled to the body frame, wherein the second end portion includes a second protruding portion protruding outward than the second edge portion in the first direction when the support frame is assembled to the body frame, and wherein each of the pair of grip portions is disposed on each of the first protruding portion and the second protruding portion.

14. The image forming apparatus according to claim 13, wherein each of the first end portion and the second end portion further includes a fitting portion extending toward the body frame, and wherein each of the first edge portion and the second edge portion includes a recessed portion depressed inward in the first direction, the fitting portion being fitted into the corresponding recessed portion when the support frame is assembled to the body frame.

15. An image forming apparatus comprising:

an image forming unit configured to form images;

an image reading unit configured to read images of an original;

a body frame accommodating the image forming unit therein; and a support frame supporting the image reading unit and disposed to confront the body frame in a confronting direction, the support frame having a first end portion and a second end portion opposite to each other in a first direction perpendicular to the confronting direction, the support frame including:

a first engaging portion provided at the first end portion;

a second engaging portion provided at the second end portion; and a pair of grip portions each provided at each of the first end portion and the second end portion, wherein the body frame has a first edge portion and a second edge portion opposite to each other in the first direction, the first edge portion and the second edge portion confronting the first end portion and the second end portion respectively when the support frame is assembled to the body frame, the body frame including:

a first engaged portion provided at the first edge portion and configured to be engaged with the first engaging portion; and a second engaged portion provided at the second edge portion and configured to be engaged with the second engaging portion, wherein the first engaging portion comprises a plurality of first engaging parts aligned in a second direction perpendicular to the confronting direction and the first direction, an outermost one of the first engaging parts in the second direction being a first outer engaging part and another one of the first engaging parts positioned farthest from the first outer engaging part in the second direction being a first opposing engaging part, wherein the second engaging portion comprises a plurality of second engaged parts aligned in the second direction, an outermost one of the second engaging parts in the second direction being a second outer engaging part and another one of the second engaging parts positioned farthest from the second outer engaging part in the second direction being a second opposing engaging part, and wherein one of the pair of grip portions is positioned between the first outer engaging part and the first opposing engaging part in the second direction, and a remaining one of the pair of grip portions is positioned between the second outer engaging part and the second opposing engaging part in the second direction.

16. The image forming apparatus according to claim 15, wherein the support frame has a lower surface confronting the body frame in the confronting direction, the lower surface being formed with recesses serving as the grip portions.

17. The image forming apparatus according to claim 15, wherein the support frame has a third end portion and a fourth end portion opposite to each other in a second direction perpendicular to the confronting direction and the first direction, the support frame further comprising a third engaging portion disposed on one of the third end portion and the fourth end portion and configured to be deformable in the second direction, and wherein the body frame has a third edge portion and a fourth edge portion opposite to each other in the second direction, the body frame further comprising a third engaged portion disposed on one of the third edge portion and the fourth edge portion and configured to be engaged with the third engaging portion.

18. An image forming apparatus comprising:

an image forming unit configured to form images;

an image reading unit configured to read images of an original;

a body frame accommodating the image forming unit therein;

a communication circuit board for establishing an electrical communication with external devices; and a support frame supporting the image reading unit and disposed to confront the body frame in a confronting direction, the support frame having a first end portion and a second end portion opposite to each other in a first direction perpendicular to the confronting direction, the support frame including:

a first engaging portion provided at the first end portion; and a second engaging portion provided at the second end portion, wherein the body frame has a first edge portion and a second edge portion opposite to each other in the first direction, the first edge portion and the second edge portion confronting the first end portion and the second end portion respectively when the support frame is assembled to the body frame, the body frame including:

a first engaged portion provided at the first edge portion and configured to be engaged with the first engaging portion;

a second engaged portion provided at the second edge portion and configured to be engaged with the second engaging portion;

a pair of first frames disposed opposite to each other in the first direction, each first frame having an end portion confronting the support frame; and a second frame spanning between the pair of first frames to connect the end portions thereof together in the first direction, wherein the second frame is further formed with a retaining portion configured to retain the communication circuit board and wherein the first engaged portion and the second engaged portion are provided on the second frame.

19. An image forming apparatus comprising:

an image forming unit configured to form images;

an image reading unit configured to read images of an original;

a body frame accommodating the image forming unit therein; and a support frame supporting the image reading unit and disposed to confront the body frame in a confronting direction, the support frame having a first end portion and a second end portion opposite to each other in a first direction perpendicular to the confronting direction, the support frame including:

a first engaging portion provided at the first end portion;

a first protruding portion provided at the first end portion and positioned outward than the first engaging portion in the first direction;

a second engaging portion provided at the second end portion; and a second protruding portion provided at the second end portion and positioned outward than the second engaging portion in the first direction, wherein the body frame has a first edge portion and a second edge portion opposite to each other in the first direction, the first edge portion and the second edge portion confronting the first end portion and the second end portion respectively when the support frame is assembled to the body frame, the body frame including:

a first engaged portion provided at the first edge portion and configured to be engaged with the first engaging portion; and a second engaged portion provided at the second edge portion and configured to be engaged with the second engaging portion, and wherein the first protruding portion and the second protruding portion protrude outward than the first edge portion and the second edge portion in the first direction respectively when the support frame is assembled to the body frame.

20. The image forming apparatus according to claim 19, wherein the support frame has a third end portion and a fourth end portion opposite to each other in a second direction perpendicular to the confronting direction and the first direction, the support frame further comprising a third engaging portion disposed on one of the third end portion and the fourth end portion and configured to be deformable in the second direction, and wherein the body frame has a third edge portion and a fourth edge portion opposite to each other in the second direction, the body frame further comprising a third engaged portion disposed on one of the third edge portion and the fourth edge portion and configured to be engaged with the third engaging portion.

* * * * *